US006123810A

United States Patent [19]

Saint Victor

[11] Patent Number: 6,123,810

[45] Date of Patent: Sep. 26, 2000

[54] PULPING COMPOSITION CONTAINING AMINOALKOXYLSILANES AND A PULPING PROCESS USING THE COMPOSITION

[75] Inventor: Marie-Esther Saint Victor, Blue Bell, Pa.

[73] Assignee: Henkel Corporation, Gulph Mills, Pa.

[21] Appl. No.: 09/021,189

[22] Filed: Feb. 10, 1998

[51] Int. Cl.[7] ..... D21C 3/20

[52] U.S. Cl. ..... 162/72; 162/80; 162/90; 516/55; 556/413

[58] Field of Search ..... 162/72, 77, 80, 162/90; 252/355, 357, 358; 556/413, 419, 425; 516/55

[56] References Cited

U.S. PATENT DOCUMENTS

| | | | |
|---|---|---|---|
| 2,930,809 | 3/1960 | Kenmore et al. | 260/448.8 |
| 5,104,576 | 4/1992 | Snow | 252/357 |
| 5,266,690 | 11/1993 | McCurry, Jr. et al. | 536/18.6 |
| 5,449,763 | 9/1995 | Wulff et al. | 536/18.6 |
| 5,474,709 | 12/1995 | Herzig et al. | 252/321 |

FOREIGN PATENT DOCUMENTS

| | | | |
|---|---|---|---|
| 92/05854 | 4/1992 | WIPO . | |
| 96/41915 | 12/1996 | WIPO | 162/72 |

OTHER PUBLICATIONS

Speier, et al., "Syntheses of (3–Aminoalkyl)silicon Compounds", J. Org. Chem., vol. 36, No. 21, Mar. 16, 1971, pp. 3120–3126.

Alkaline Pulping, Pulp and Paper Manufacture, vol. 5, 3rd. Ed., 1989, p. 50.

K. E. Vroom, "The "H" Factor: A Means Of Expressing Cooking Times and Temperatures as a Single Variable", Pulp and Paper Magazine of Canada, vol. 58, (1957), pp. 228–231.

Tsai, et al., "Synthesis of 1,1–Diethoxy–2–(trimethylsilyl)–1–sila–2–azacyclopentane", The Journal of Organic Chemistry, vol. 34, No. 11, Nov., 1969, pp. 3676–3679.

Chemical Abstract 54:19484d.

Chemical Abstract 56:5993e.

Chemical Abstract 84:75014.

Chemical Abstract 86:72863.

Chemical Abstract 70:57988.

Chemical Abstract 74:42481.

*Primary Examiner*—Steve Alvo
*Attorney, Agent, or Firm*—John E. Drach; Steve J. Trzaska

[57] ABSTRACT

Enhanced removal of lignin and other extractives in a pulping process is achieved by contacting wood chips and the like with a liquid mixture comprised of white liquor and aminoalkoxylsilane and optionally, one or more nonionic and/or anionic surfactants.

28 Claims, No Drawings

PULPING COMPOSITION CONTAINING AMINOALKOXYLSILANES AND A PULPING PROCESS USING THE COMPOSITION

BACKGROUND OF THE INVENTION

Chemical pulping is a process whereby wood chips, wood shavings, and/or sawdust are heated at elevated temperatures in an aqueous acid or alkaline solution, also known as white liquor or cooking liquor, in order to remove enough lignin so that the cellulose fibers can be readily separated from one another. Typically, the process is carried out by heating a mixture of wood chips and cooking liquor in a large pressure vessel called a digester. The cooking temperature is usually in the 170–175° C. range with a corresponding cooking time of at least 90 minutes. The cooked chips are discharged or blown from the digester under pressure, the mechanical force of which breaks up the wood chips into individual fibers, producing the pulp. The pulp from the digester contains fiber and exhausted liquor which is black in color. The black liquor is washed from the pulp which is then screened to remove uncooked chips and other large fragments and sent on for further processing.

The efficiency of the pulping process is reflected in the degree of delignification which depends upon the extent of the penetration of the cooking liquor and the uniformity of the distribution of the liquor within the chips. Inadequate impregnation usually results in a high level of screen rejects and low pulp yield. The current trends in research and development of the pulping industry are leading towards the use of digester aids. Digester aids are materials that are added to the white liquor to increase the yield and rate. To be most efficient, these digester aids must be soluble and stable under the pulping conditions.

Anthraquinone is an example of a compound that is widely employed as a digester aid because of its relatively low cost and lack of interference with downstream paper making operations.

Unfortunately, the known digester aids are not completely satisfactory, for example, for environmental considerations in certain cases or for lack of adequate penetration and extraction of undesirable organic components in other cases. Prior to the present invention, there existed no known system which enhanced the efficiency of the pulp digestion through enhanced removal of lignin and other extractives to desired levels.

BRIEF SUMMARY OF THE INVENTION

The present invention is an improvement in the conventional chemical pulping processes by improving the delignification of pulp. The surprising discovery has been made that the addition of a digester aid of the formula III

III

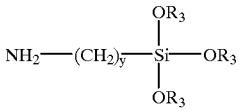

wherein $R_3$ is an organic moiety having from 1 to about 100 carbon atoms and wherein y is an integer having a value of from 1 to about 30 to the pulping liquor enhances the removal of lignin and extractives while simultaneously improving both the rate of penetration of pulping liquor into cellulose pulp and reducing the pulping cycle times. The process according to the invention comprises contacting wood chips and the like with a digester aid which is a liquid mixture comprised of at least one compound of the formula III and white liquor, black liquor, or a combination thereof. In addition to a compound of the formula III, the digester aid can also contain at least one surfactant as disclosed herein below. The digester aid concentration in the pulping liquor and the contact time with the pulp chips are each adjusted so that resinous components are extracted from the pulp without substantial degradation of cellulose. After contacting at least a portion of the resulting liquid mixture-pulp combination, it is heated to a digestion temperature typically above about 150° C. The heating is also referred to as cooking.

DETAILED DESCRIPTION OF THE INVENTION

As employed herein, the term "pulping liquor" means white liquor, black liquor or a combination thereof. White liquor is a term well known to those skilled in the art of cellulose pulping and is usually taken to mean an aqueous mixture of alkali metal hydroxide and a sulfide with or without further additives and in concentrations well known in the art. Black liquor is also a term well known to those skilled in the art of cellulose pulping and is usually taken to mean the black, liquid digester effluent which contains, inter alia, sulfonated lignin, rosin acids, and other waste-wood components. The Kappa number, which is directly proportional to the amount of lignin remaining in the pulp, is the volume (in millimeters) of 0.1 N potassium permanganate solution consumed by one gram of moisture-free pulp under the conditions specified in TAPPI method T 236 cm-85, the method used to determine the Kappa number. The term pulping cycle time as used herein refers to the time required to cook a sample of wood chips and the like to a given residual effective alkali.

In the process according to the invention, wood chips, wood shavings, and/or sawdust and the like are contacted with a digester aid which is a liquid mixture comprised of an aminoalkoxylsilane and white liquor, black liquor, or a combination thereof and optionally, at least one surfactant as disclosed herein below.

The aminoalkoxylsilanes have the formula III

III

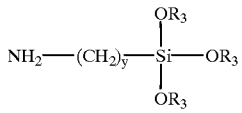

wherein $R_3$ is an organic moiety having from 1 to about 100 carbon atoms and wherein y is an integer having a value of from 1 to about 30. The organic moiety can be an aliphatic or aromatic radical having from 1 to about 100 carbon atoms and can also contain one or more hetero atoms including but not limited to oxygen, nitrogen, sulfur and phosphorus. Examples of aliphatic moieties include but are not limited to alkyl radicals, substituted alkyl radicals, alkenyl radicals and substituted alkenyl radicals having from 1 to about 100 carbon atoms. Examples of aromatic moieties include but are not limited to phenyl radicals and substituted phenyl radicals having from 6 to about 100 carbon atoms. Preferred compounds of formula III are those wherein y is from 1 to 3 and each of $R_3$ is an alkyl group having from 1 to 4 carbon atoms. Most preferred compounds of formula III are those wherein y is 3 and each of $R_3$ is a methyl or an ethyl group.

The aminoalkoxylsilanes can be made by hydrogenation of cyanoalkylalkoxysilanes as described in U.S. Pat. No.

2,930,809 and in the Journal of Organic Chemistry, Volume 36, pp 3120–3126 (1971). The most preferred aminoalkoxylsilanes, 3-aminopropyltrimethoxysilane and 3-aminopropyltriethoxysilane, can be purchased from Aldrich Chemical Company, Milwaukee, Wis. 53233.

The concentration of the aminoalkoxylsilanes in the pulping liquor which together form the liquid mixture for contacting the pulp can be any amount that is effective to enhance the removal of lignin and extract the resinous components from the pulp without substantially degrading the cellulose. Typically, the amount of aminoalkoxylsilane will range from 0.05% (w/w) to 1.0% and preferably between about 0.05% (w/w) and about 0.5% (w/w) and most preferably from 0.25% to 0.50% based on the weight of oven dry wood. Typically, the specific components extracted from the wood chips include resins, fatty acids, and lignins.

The liquid mixture which contains the aminoalkoxylsilanes and the pulping liquor is prepared by mixing the aminoalkoxylsilane and any additional substances such as the surfactants disclosed herein and the pulping liquor using standard mixing equipment. The amount of liquid mixture that can be used to treat the pulp can vary from 70% to 85% and preferably from 75% to 80% based on the weight of oven dry wood.

The liquid mixture which contains the aminoalkoxylsilanes and the pulping liquor can optionally contain one or more nonionic and/or anionic surfactants.

The nonionic surfactants most useful are those having an HLB value of from 9 to 16 and are selected from the group consisting of polymethylalkylsiloxanes alkoxylated silicones, co- or terpolymers of alkoxylated silicones; alkoxylated aryl phosphates; alkoxylated branched alkyl phosphates; alkoxylated branched and unbranched aliphatic alcohols; and alkyl polyglycosides. Anionic surfactants which are useful in the practice of this invention are those selected from the group consisting of a mixture of alkali metal salts of alkyl aromatic sulfates, sulfosuccinates and a silicone; and mixtures thereof.

Polymethylalkylsiloxanes are compounds of the formula II

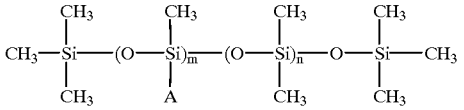

(II)

wherein $A{=}(CH_2)_x{-}O{-}(C_2H_4O)_y{-}(C_3H_6O)_z{-}R$; R is an organic moiety having from 1 to 8 carbon atoms such as an alkyl and/or alkenyl group, a substituted alkyl and/or alkenyl group, an acyloxy group; m is a number from 1 to 100, n is a number from 0 to 100, x is an integer from 1 to 3, y is a number from 1 to 100 and, z is a number from 0 to 100. Preferred polymethylalkylsiloxanes are those wherein n=0, m=1, x=3, y=8, z=0 and, R is methyl; n=35, m=11, x=3, y=18, z=0 and, R is methyl; n=0, m=1, x=3, y=8, z=0 and, R is acetoxy.

In the case of silicones and copolymers of silicones and ethoxylated polyhydric alcohols, relatively high degrees of ethoxylation, e.g., about 12 to 44, preferably about 22 to 44, have been found to be preferable for the purposes of this invention. These findings are applicable to a wide range of branched alkyl and aryl phosphates, branched alcohols, alkyl polyglycosides, and like compositions and mixtures.

Alkoxylated silicones, co- and terpolymers of alkoxylated silicones are described in WO 92/05854, the entire contents of which are incorporated herein by reference.

An alkoxylated polyol is any compound having at least 2 alcohol groups wherein all or substantially all of the alcohol functionalities are etherified with a polyoxyalkylene having a degree of polymerization of at least 2 examples of which include but are not limited to ethoxylated polyols, propoxylated polyols, butoxylated polyols, and random and block ethoxylated-propoxylated polyols. Preferably, the alkoxylated polyols are ethoxylated polyols.

An ethoxylated polyol is any compound having at least 2 alcohol groups wherein all or substantially all of the alcohol functionalities are etherified with polyoxyethylene having a degree of polymerization of at least 2. Such ethoxylated polyols include, but are not limited to, ethoxylated diols such as ethylene glycol, 1,2-propylene glycol, diethylene glycol, triethylene glycol, and polyethylene glycols of various degrees of polymerization; triols such as glycerine, trimethylolethane [2-methyl-2-(hydroxymethyl)-1,3-propanediol], trimethylolpropane [2-ethyl-2-(hydroxymethyl)-1,3-propanediol]. Polyols also include pentaerythritol (2,2-dimethylol-1,3-propanediol), diglycerol (glycerol dimer), dipentaerythritol, triglycerine, and the like.

Alkoxylated aryl phosphates are phosphate esters which are a mixture of mono-, di-, and tri-esters of phosphoric acid esterified with alkoxylated phenols or alkyl-substituted phenols. Alkoxylated branched alkyl phosphates are phosphate esters which are a mixture of mono-, di-, and tri-esters of phosphoric acid esterified with alkoxylated branched aliphatic alcohols. Preferably, the alkoxylated aryl phosphates are ethoxylated aryl phosphates. Preferably, the alkoxylated alkyl phosphates are ethoxylated alkyl phosphates.

The alkyl polyglycosides which can be used in the invention have the formula I $$R_1O(R_2O)_b(Z)_a \qquad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, PLANTAREN®) or AGRIMUL® surfactants from Henkel Corporation, Ambler, Pa., 19002. Examples of such surfactants include but are not limited to:

1. GLUCOPON® 220 Surfactant—an alkyl polyglycoside in which the alkyl group contains 8 to 10 carbon atoms and having an average degree of polymerization of 1.5.
2. GLUCOPON® 225 Surfactant—an alkyl polyglycoside in which the alkyl group contains 8 to 10 carbon atoms and having an average degree of polymerization of 1.7.
3. GLUCOPON® 600 Surfactant—an alkyl polyglycoside in which the alkyl group contains 12 to 16 carbon atoms and having an average degree of polymerization of 1.4.
4. GLUCOPON® 625 Surfactant—an alkyl polyglycoside in which the alkyl group contains 12 to 16 carbon atoms and having an average degree of polymerization of 1.4.
5. APG® 325 Surfactant—an alkyl polyglycoside in which the alkyl group contains 9 to 11 carbon atoms and having an average degree of polymerization of 1.6.
6. PLANTAREN® 2000 Surfactant—an alkyl polyglycoside in which the alkyl group contains 8 to 16 carbon atoms and having an average degree of polymerization of 1.4.
7. PLANTAREN® 1300 Surfactant—an alkyl polyglycoside in which the alkyl group contains 12 to 16 carbon atoms and having an average degree of polymerization of 1.6.

8. AGRIMUL® PG 2067 Surfactant—an alkyl polyglycoside in which the alkyl group contains 8 to 10 carbon atoms and having an average degree of polymerization of 1.7.

Other examples include alkyl polyglycoside surfactant compositions which are comprised of mixtures of compounds of formula I as described in U.S. Pat. Nos. 5,266,690 and 5,449,763, the entire contents of both of which are incorporated herein by reference.

The alkoxylated branched and unbranched aliphatic alcohols which can be used in the process according to the invention are those branched and unbranched alcohols having from 3 to 22 carbon atoms, preferably 8 to 18 carbon atoms. Preferred compounds are ethoxylated branched and unbranched aliphatic alcohols having from 8 to 18 carbon atoms such as ethoxylated tridecyl alcohol. Preferred surfactants include anionic and nonionic surfactants selected from the group consisting of the following: (1) a polymethylalkylsiloxane of the formula II wherein n=0, m=1, x=3, y=8, z=0 and, R is acetoxy; (2) a polymethylalkylsiloxane of the formula II wherein n=35,m=11,x=3,y=18,z=O and, R is methyl; (3) a polymethylalkylsiloxane of the formula II wherein n=0, m=1, x=3, y=8, z=0 and, R is methyl; (4) a phosphated aryl ethoxylate which is commercially available as AQUAQUEST® 601 P and TRYFAC® from Henkel Corporation; (5) an ethoxylated tridecyl alcohol which is commercially available as TRYCOL® 5941 from Henkel Corporation; (6) a blend of sodium alkyl aromatic sulfonate, sodium sulfosuccinate and silicone which is commercially available as STANTEX®40 DF from Henkel Corporation.

A preferred composition is comprised of: (a) pulping liquor; (b) a compound of the formula III and; (c) an alkyl polyglycoside of the formula I. Another preferred composition is comprised of: (a) pulping liquor; (b) a compound of the formula III; (c) an alkyl polyglycoside of the formula I and: (d) a compound of the formula II. Another preferred composition is comprised of: (a) pulping liquor; (b) a compound of the formula III and; (c) a compound of the formula II.

The contacting or residence time may vary with the type of pulp and will be easily determinable by those skilled in the art. The residence time for contacting is preferably between about 45 minutes and about 180 minutes. The contacting temperature may vary with the type of pulp and will be easily determinable by those skilled in the art. The contacting temperature is preferably maintained at or below about 80° C. The digestion temperature can vary but will typically be above about 150° C. and is preferably between 160–175° C.

The present invention is applicable to any chemical pulping process including the pulping of wood chips from oak, gum, birch, poplar and maple trees. The pulping process may be the well-known Kraft process in which wood chips are cooked in an aqueous solution containing NaOH and $Na_2S$, or an acid sulfite system.

The following examples are meant to illustrate but not to limit the invention.

EXAMPLE 1

LIQUOR PENETRATION DETERMINATION PROCEDURE

The extent of liquor penetration into hardwood or soft wood chips is determined by means of a gravimetric test. The cooking liquor comprises 0.25% of an aminoalkylalkoxysilane in white liquor on a weight basis. The liquor may be sodium hydroxide for soda pulping, or a mixture comprising sodium hydroxide and sodium sulfide for Kraft pulping. The liquor is pre-heated at 70° C. The chips are immersed in the liquor (Kraft or soda) for a period of 30 minutes. The temperature is maintained constant over the impregnation time. The chips are then filtered from the liquor and weighed. The liquor uptake is calculated as a ratio of the weight of penetrated chips over the weight of the initial chips. The black liquors generated are submitted to tests described below. The composition of a typical cooking liquor is as follows:

NaOH Concentration: 25.6 g/l as $Na_2O$ $Na_2S$ Concentration: 9.75 g/l as $Na_2O$ Sulfidity: 27.6%

Liquor/Wood Ratio: 4/1

EXAMPLE 2

ANALYSIS OF BLACK LIQUOR

The residual alkali and the amount of organic material extracted from the wood chips are determined according to standard methods. Active alkali, total alkali and effective alkali (EA) are defined in TAPPI Standard T1203 os-61 and are determined using TAPPI methods T624 cm-85 and T625 cm-85. The effective alkali of black liquors is defined as the residual effective alkali. The alkali content is determined by means of a standard titration method as set forth in the TAPPI method. Effective alkali uptake (EAU) is calculated and used as a measure of the hydroxyl uptake at the initial phase of delignification. Effective Alkali Uptake (EAU) is given by the following equation:

$EAU=(EA_{white\ liquor}\text{-Residual } EA_{black\ liquor})/EA_{white\ liquor})\times 100$ The residual sodium sulfide and percent sulfidity are also determined.

EXAMPLE 3

STANDARD KRAFT PULPING PROCEDURE

A 4-liter pressure reactor is charged with white liquor and heated to 80° C. The digester aid comprised of pulping liquor and the aminoalkylalkoxysilane is added slowly. Wood chips are then added so that the liquor to wood ratio is from 4:1 to 3:1 based on weight of oven dry wood. The reactor is purged with nitrogen and then sealed. The temperature is increased at such a rate that it reaches a maximum of 170° C. in one hour. The temperature is recorded every 10 minutes and used to calculate the total H-factor for a particular pulping study. For example, a pulping reaction is studied so that an H-factor is identified for a given temperature reading at a given time. The H-factors are found in table 13 on page 50 of Pulp and Paper Manufacture, Volume 5, third edition, 1989, the entire contents of which are incorporated herein by reference, which lists the H-factors for temperatures from 100° C. to 199° C. (see also Pulp Paper Mag. Can., Volume 58, pages 228–231 (1957)). The H-factor for each temperature up to 170° C. is recorded and added together. The sum of the H-factors will lie in the range of 800–1150. Pulping runs are cooked to the same H-factors and the data for the same H-factor runs are compared. The shorter the time period required to arrive at a given H-factor, the more efficient the pulping reaction and the shorter the cycle time. Black liquor samples are taken from the reactor at the same time intervals that the temperatures are recorded. Lignin and total organic content of black liquors is determined by means of ultraviolet spectroscopy as set forth in Example 6. The Kappa number for each run is determined according to TAPPI method T 236 cm-85. Since the Kappa number measures the amount of lignin remaining in the pulp, the lower the Kappa number for a given cook, the more efficient the lignin removal.

EXAMPLE 4

LIGNIN AND TOTAL ORGANIC ANALYSIS

Black or white liquor is filtered using a 0.2 $\mu$m pore size filter. About 20 ml of the filtrate is diluted with distilled water to a volume of 10 ml. UV absorption spectrum is taken with respect to the initial white liquor in the region of 190 nm to 450 nm, using a Perkin-Elmer UV/visible spectrophotometer and 1-cm quartz cuvette. For quantitative determination, the areas under the peaks are integrated using a FTIR-UV software. The UV spectrum shows three specific maxima between 250 nm and 360 nm, at 268, 290, 360 respectively. A standard is made by dissolving alkali lignin in white liquor in a wide range of concentrations. Absorption of the lignin samples is measured as described above. Two maxima are observed in the region between 250 nm–300 nm. Consequently, for the black liquors, the peaks in the 250–300 nm regions are considered specifically caused by lignin structural groups. The total organic extraction is calculated from the maxima obtained in the entire 250–450 region.

Tables 1 and 2 illustrate the efficacy of digester aids according to the invention. Table 1 illustrates the efficiency of 3-Aminopropylmethoxysilane as a pulping additive. Table 2 compares the efficiency of two pulping additives: 3-aminopropylmethoxysilane and a combination of TEGOPREN® 5878 and GLUCOPONO® 220 in a 1 to 7.2 weight ratio. TEGOPREN® 5878 is a polymethylalkylsiloxane.

TABLE 1

Efficiency of 3-Amino propyl methoxy silane as pulping additive

| | Additive Conc. in white liquor | Dosage % based on weight of odw* | Lignin Extraction (UV area) | Effective Alkali Uptake (%) |
|---|---|---|---|---|
| Control | 0 | 0 | 104.724 | 23.02 |
| Additive Cook[a]-1 | 725.2 | 0.25 | 168.37 | 26.57 |
| Additive Cook-2 | 1405.2 | 0.5 | 176.282 | 25.97 |

[a] - additive is 3-aminopropylmethoxysilane
*ODW: oven dry wood

TABLE 2

Comparison of the efficiency of two pulping additives: 3-Aminopropylmethoxy silane and TEGOPREN ® 5878 + GLUCOPON ® 220(1:7.2)

| | Additive Conc. in white liquor (ppm) | Dosage % based on weight of odw* | Lignin Extraction (UV area) | Effective Alkali Uptake (%) |
|---|---|---|---|---|
| Control | 0 | 0 | 104.724 | 23.02 |
| Amino-propyl-methoxy-silane | 725.2 | 0.25 | 168.37 | 26.57 |
| Tegopren - Glucopon 220 | 722.4 | 0.25 | 143.08 | 25.43 |

*ODW: oven dry wood

What is claimed is:

1. A composition comprising pulping liquor and a compound of the formula III

III

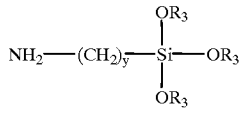

wherein $R_3$ is an organic moiety having from 1 to about 100 carbon atoms and wherein y is an integer having a value of from 1 to about 30.

2. The composition of claim 1 wherein y has a value of from 1 to 3 and each of $R_3$ is an alkyl group having from 1 to 4 carbon atoms.

3. The composition of claim 1 wherein y has a value of 3 and each of $R_3$ is a methyl or an ethyl group.

4. The composition of claim 1 wherein the amount of the compound of formula III in the composition is from about 0.05 to about 1.0 weight %.

5. The composition of claim 4 wherein the amount of the compound of formula III in the composition is from about 0.05 to about 0.5 weight %.

6. The composition of claim 1 wherein the amount of the compound of formula III the composition is from about 0.25 to about 0.5 weight %.

7. The composition of claim 1 further comprising an alkyl polyglycoside of the formula I $$R_1O(R_2O)_b(Z)_a \qquad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6.

8. The composition of claim 1 further comprising a compound of the formula II (II)

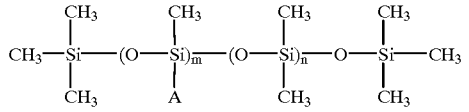

wherein $A{=}(CH_2)_x{-}O{-}(C_2H_4O)_y{-}(C_3H_6O)_z{-}R$; R is an organic moiety having from 1 to 8 carbon atoms such as an alkyl and/or alkenyl group, a substituted alkyl and/or alkenyl group, an acyloxy group; m is a number from 1 to 100, n is a number from 0 to 100, x is an integer from 1 to 3, y is a number from 1 to 100 and, z is a number from 0 to 100.

9. A composition comprising: (a) pulping liquor; (b) a compound of the formula III

III

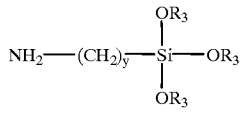

wherein $R_3$ is an organic moiety having from 1 to about 100 carbon atoms and wherein y is an integer having a value of from 1 to about 30; (c) an alkyl polyglycoside of the formula I $$R_1O(R_2O)_b(Z)_a \quad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6; (d) a compound of the formula II (II)

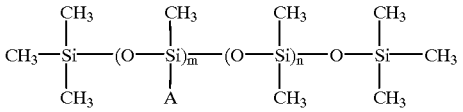

wherein $A{=}(CH_2)_x{-}O{-}(C_2H_4O)_y{-}(C_3H_6O)_z{-}R$; R is an organic moiety having from 1 to 8 carbon atoms such as an alkyl and/or alkenyl group, a substituted alkyl and/or alkenyl group, an acyloxy group; m is a number from 1 to 100, n is a number from 0 to 100, x is an integer from 1 to 3, y is a number from 1 to 100 and, z is a number from 0 to 100.

10. The composition of claim 9 wherein y has a value of from 1 to 3 and each of $R_3$ is an alkyl group having from 1 to 4 carbon atoms.

11. The composition of claim 10 wherein y has a value of 3 and each of $R_3$ is a methyl or an ethyl group.

12. The composition of claim 9 wherein the amount of the compound of formula III in the composition is from about 0.05 to about 1.0 weight %.

13. The composition of claim 12 wherein the amount of the compound of formula III in the composition is from about 0.05 to about 0.5 weight %.

14. The composition of claim 13 wherein the amount of the compound of formula III in the composition is from about 0.25 to about 0.5 weight %.

15. An improved pulping process which comprises contacting wood chips and the like with a liquid mixture comprised of pulping liquor and a compound of the formula III

III

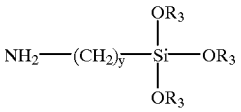

wherein $R_3$ is an organic moiety having from 1 to about 100 carbon atoms and wherein y is an integer having a value of from 1 to about 30.

16. The process of claim 15 wherein y has a value of from 1 to 3 and each of $R_3$ is an alkyl group having from 1 to 4 carbon atoms.

17. The process of claim 15 wherein y has a value of 3 and each of $R_3$ is a methyl or an ethyl group.

18. The process of claim 15 wherein the amount of the compound of formula III in the liquid mixture is from about 0.05 to about 1.0 weight %.

19. The composition of claim 18 wherein the amount of the compound of formula III in the liquid mixture is from about 0.05 to about 0.5 weight %.

20. The process of claim 19 wherein the amount of the compound of formula III in the liquid mixture is from about 0.25 to about 0.5 weight %.

21. The process of claim 15 wherein the liquid mixture is further comprised of an alkyl polyglycoside of the formula I $$R_1O(R_2O)_b(Z)_a \quad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6.

22. The process of claim 15 wherein the liquid mixture is further comprised of a compound of the formula II (II)

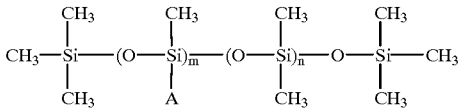

wherein $A{=}(CH_2)_x{-}O{-}(C_2H_4O)_y{-}(C_3H_6O)_z{-}R$; R is an organic moiety having from 1 to 8 carbon atoms such as an alkyl and/or alkenyl group, a substituted alkyl and/or alkenyl group, an acyloxy group; m is a number from 1 to 100, n is a number from 0 to 100, x is an integer from 1 to 3, y is a number from 1 to 100 and, z is a number from 0 to 100.

23. An improved pulping process which comprises contacting wood chips and the like with a liquid mixture comprised of: (a) pulping liquor; (b) a compound of the formula III

III

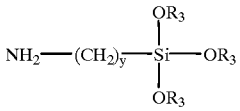

wherein $R_3$ is an organic moiety having from 1 to about 100 carbon atoms and wherein y is an integer having a value of from 1 to about 30; (c) an alkyl polyglycoside of the formula I $$R_1O(R_2O)_b(Z)_a \quad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6; (d) a compound of the formula II (II)

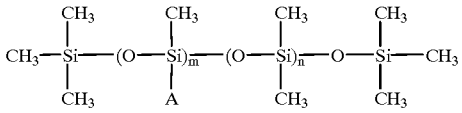

wherein $A{=}(CH_2){-}O{-}(C_2H_4O)_y{-}(C_3H_6O)_z{-}R$; R is an organic moiety having from 1 to 8 carbon atoms such as an alkyl and/or alkenyl group, a substituted alkyl and/or alkenyl group, an acyloxy group; m is a number from 1 to 100, n is a number from 0 to 100, x is an integer from 1 to 3, y is a number from 1 to 100 and, z is a number from 0 to 100.

24. The process of claim 23 wherein y has a value of from 1 to 3 and each of $R_3$ is an alkyl group having from 1 to 4 carbon atoms.

25. The process of claim 23 wherein y has a value of 3 and each of $R_3$ is a methyl or an ethyl group.

26. The process of claim 23 wherein the amount of the compound of formula III in the liquid mixture is from about 0.05 to about 1.0 weight %.

27. The composition of claim 26 wherein the amount of the compound of formula III in the liquid mixture is from about 0.05 to about 0.5 weight %.

28. The process of claim 27 wherein the amount of the compound of formula III in the liquid mixture is from about 0.25 to about 0.5 weight %.

* * * * *